US009915116B2

(12) United States Patent
Jacob et al.

(10) Patent No.: US 9,915,116 B2
(45) Date of Patent: Mar. 13, 2018

(54) DELIVERING AN AGENT INTO A WELL USING AN UNTETHERED OBJECT

(71) Applicant: Schlumberger Technology Corporation, Sugar Land, TX (US)

(72) Inventors: Gregoire Jacob, Houston, TX (US); Indranil Roy, Missouri City, TX (US); Michael Dardis, Richmond, TX (US); John Fleming, Damon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/014,791

(22) Filed: Feb. 3, 2016

(65) Prior Publication Data

US 2016/0251935 A1 Sep. 1, 2016

Related U.S. Application Data

(60) Provisional application No. 62/126,139, filed on Feb. 27, 2015.

(51) Int. Cl.

| | |
|---|---|
| ***E21B 27/02*** | (2006.01) |
| ***E21B 34/06*** | (2006.01) |
| ***E21B 34/14*** | (2006.01) |

(52) U.S. Cl.

CPC ..... *E21B 27/02* (2013.01); *E21B 34/063* (2013.01); *E21B 34/14* (2013.01)

(58) Field of Classification Search

CPC ..... E21B 27/02; E21B 34/063; E21B 34/14
See application file for complete search history.

(56) References Cited

U.S. PATENT DOCUMENTS

| | | | | |
|---|---|---|---|---|
| 2,109,058 | A * | 2/1938 | Blee | E21B 27/02 166/117 |
| 6,655,475 | B1 * | 12/2003 | Wald | E21B 27/02 166/117 |
| 7,891,424 | B2 * | 2/2011 | Creel | E21B 27/02 166/286 |
| 8,025,102 | B2 * | 9/2011 | Dewar | E21B 27/02 166/153 |
| 8,584,746 | B2 * | 11/2013 | Marya | E21B 33/12 166/192 |
| 8,950,438 | B2 * | 2/2015 | Ryan | E21B 29/10 138/98 |
| 2007/0107908 | A1 * | 5/2007 | Vaidya | E21B 34/14 166/376 |
| 2011/0221137 | A1 * | 9/2011 | Obi | C09K 3/12 277/316 |
| 2012/0285695 | A1 * | 11/2012 | Lafferty | C09K 8/03 166/310 |
| 2015/0159462 | A1 * | 6/2015 | Cutler | E21B 33/12 166/377 |

* cited by examiner

*Primary Examiner* — Matthew R Buck

(57) ABSTRACT

An embodiment may take the form of a method usable with a well including pumping an untethered object into the well to land on a restriction downhole in the well and using the restriction to trigger release of an agent carried by the object into the well. Another embodiment may take the form of an apparatus usable with a well having a solid object adapted to be pumped into the well and an agent to be adapted to be released from the solid object in response to the solid object landing on a restriction in the well.

7 Claims, 12 Drawing Sheets

DELIVERING AN AGENT INTO A WELL USING AN UNTETHERED OBJECT

This application claims the benefit of, U.S. Provisional Patent Application Ser. No. 62/126139 filed on Feb. 27, 2015, incorporated by reference in its entirety.

BACKGROUND

For purposes of preparing a well for the production of oil or gas, various fluid barriers may be created downhole. For example, in a fracturing operation, a fluid barrier may be formed in the well inside a tubing string for purposes of diverting fracturing fluid into the surrounding formation. As other examples, a fluid barrier may be formed in the well for purposes of pressurizing a tubing string to fire a tubing conveyed pressure (TCP) perforating gun or for purposes of developing a pressure to shift open a string-conveyed valve assembly.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

An embodiment may take the form of a method usable with a well including pumping an untethered object into the well to land on a restriction downhole in the well and using the restriction to trigger release of an agent carried by the object into the well. Another embodiment may take the form of an apparatus usable with a well having a solid object adapted to be pumped into the well and an agent to be adapted to be released from the solid object in response to the solid object landing on a restriction in the well. Another embodiment may take the form of an apparatus usable with a well including a string comprising a passageway, a restriction in the passageway, and an untethered object. The untethered object includes a solid object adapted to be pumped into the well and an agent to be adapted to be released from the solid object in response to the solid object landing on a restriction in the well.

Advantages and other features will become apparent from the following drawing, description and claims.

DETAILED DESCRIPTION

Systems and techniques are disclosed herein for purposes of delivering an agent to a targeted downhole location in a well and releasing the agent to perform a downhole function. In this manner, as described herein, the agent may be used for such purposes as enhancing sealing; altering a degradation rate of one or more downhole components; delivering a protective coating to downhole components; and plugging pores of the well. In accordance with example systems and techniques that are described herein, the agent is delivered using an untethered object assembly. In this context, an "untethered object assembly" or "untethered object" refers to an object that travels at least some distance in a well passageway without being attached to a conveyance mechanism (a slickline, wireline, coiled tubing string, and so forth). As specific examples, the untethered object assembly may contain a solid part, such as a dart, ball or a bar. However, the untethered object assembly may take on different forms, in accordance with further implementations.

In accordance with example implementations disclosed herein, the untethered object assembly may be pumped into the well (i.e., pushed into the well with fluid). Moreover, the pumping may be used to land the untethered object assembly in a downhole restriction. In this manner, the "restriction" maybe a restriction in the passageway of a tubular string of the well. In accordance with example implementations, the landing of the untethered object assembly in the restriction triggers the release of an agent that is carried by the untethered object assembly for purposes of performing a downhole function. The agent that is carried downhole by the untethered object assembly may take on numerous forms. In this manner, the agent may be a liquid, powder, a solid, fibers, particles, a mixture of any of the foregoing components, and so forth.

Figure 1:
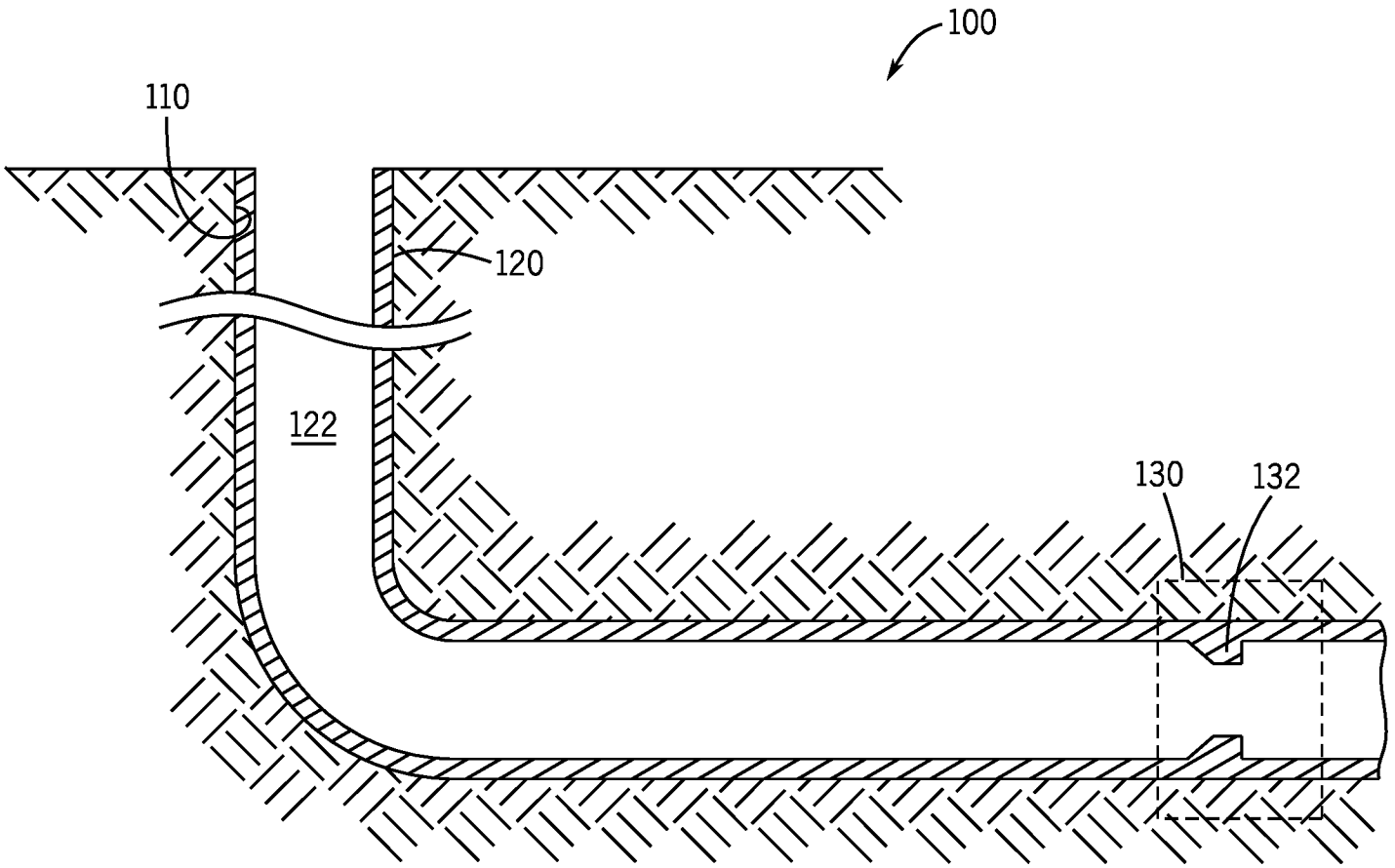
FIG. 1 is a schematic diagram of a well according to an example implementation.

As a more specific example, FIG. 1 schematically depicts a well 100 in accordance with example implementations. In general, the well 100 includes a wellbore 110, which traverses one or more formations (hydrocarbon bearing formations, for example). For the example of FIG. 1, the wellbore 110 may be lined, or supported, by a tubing string 120. The tubing string 120 may be cemented to the wellbore 110 (such as wellbores typically referred to as "cased hole" wellbores); or the tubing string 120 may be secured to the formation(s) by packers (such as the case for wellbores typically referred to as "open hole" wellbores).

For the example implementation of FIG. 1, the tubing string 120 has a central passageway 122 and a corresponding lateral portion that contains a restriction 130.

It is noted that although FIG. 1 depicts a laterally extending wellbore, the systems and techniques that are disclosed herein may likewise be applied to vertical wellbores. In accordance with example implementations, the well 100 may contain multiple wellbores, which contain tubing strings that are similar to the illustrated tubing string 120. Moreover, depending on the particular implementation, the well 100 may be an injection well or a production well. Thus, many variations are contemplated, which are within the scope of the appended claims.

Figure 2A:
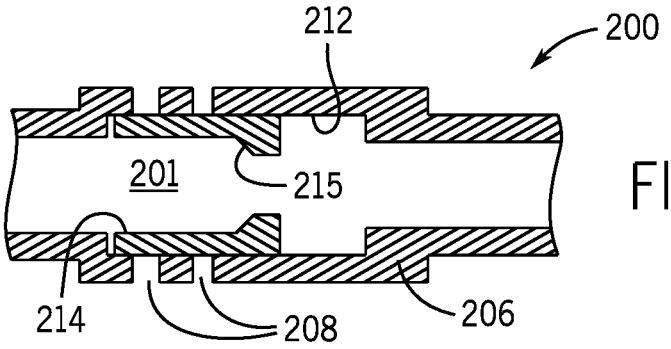
FIGS. 2A, 2B, 2C and 2D are cross-sectional view of downhole restrictions according to example implementations.

More specifically, in accordance with example implementations, the restriction 130 may be formed from a valve assembly 200 that is illustrated in FIG. 2A. In this regard, referring to FIG. 2A in conjunction with FIG. 1, the valve assembly 200 may include an outer tubular housing 206, which is constructed to be installed in line with the tubing string 120; and the outer housing 206 may contain radial flow ports 208 that, when the valve assembly 200 is open, establish fluid communication between a central passageway 201 of the valve assembly 200 and the region outside of the housing 206. As illustrated in FIG. 2A, the valve assembly 200 contains an inner sleeve 214 that operates within a defined annular inner space 212 of the housing 206 for purposes of opening and closing fluid communication through the radial flow ports 208.

As a more specific example, in accordance with some implementations, the valve assembly 200 may be a shifting-type valve assembly that is operated by, for example, lodging an object in a narrowed opening, or seat 215, of sleeve 214 for purposes of shifting the sleeve 214.

Figure 2B:
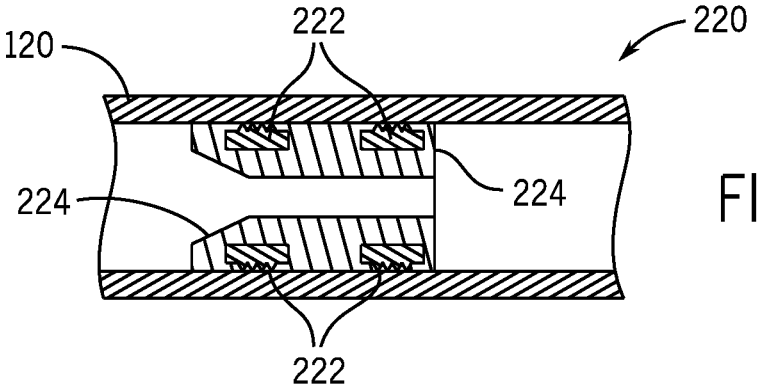

As another example, the restriction 130 may be formed from a plug or anchored seat assembly 220 that is depicted in FIG. 2B. Referring to FIG. 2B in conjunction with FIG. 1, the assembly 220 includes a seat portion 224 that is run downhole inside the passageway 122 (see FIG. 1) to a desired location and set. For example, the setting of the seat portion 224 inside the tubing string 120 may occur by setting corresponding slips 226 that secure the seat portion 224 to the inner wall of the tubing string 120. As illustrated in FIG. 2B, the seat portion 224 has a restricted inner passageway 224 to form a restriction.

Figure 2C:
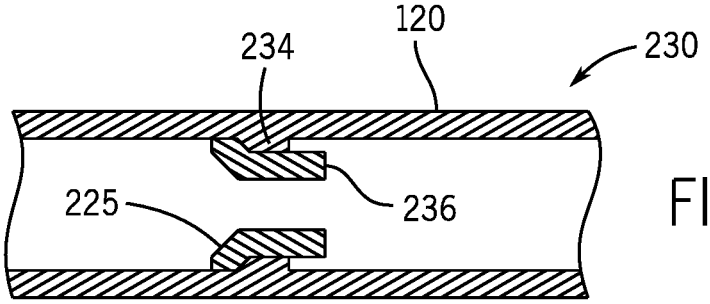

As another example of a restriction 130, FIG. 2C illustrates a seat assembly 230. Referring to FIG. 2C in conjunction with FIG. 1, for this example implementation, the tubing string 120 contains an inner shoulder 234 (i.e., a first restriction), which is constructed to receive a seat 236 that is run into the string 110. The seat 236 is constructed to land on the restriction 234 to form a second restriction 225.

Figure 2D:
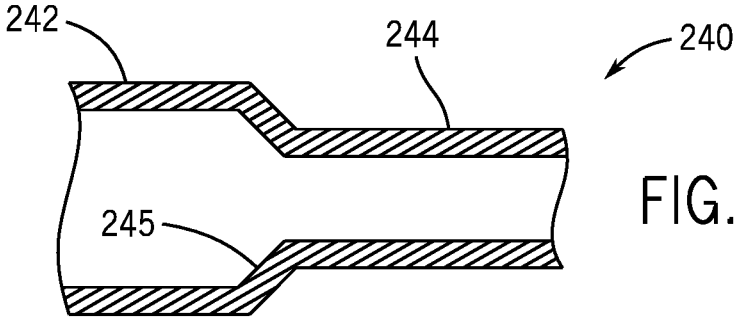

Referring to FIG. 2D in conjunction with FIG. 1, in accordance with further example implementations, a restriction 240 may be formed by a reduction in the string diameter. For this example, the restriction 240 includes a seat 245 that is formed from the reduction of diameters between a first string section 242 and a reduced diameter, second string section 244.

For example implementations that are discussed below, the restriction 130 is formed by the seat 132 of FIG. 1, although the restriction 130 may take on other forms, such as any of the restrictions of FIGS. 2A-2D, as well as other restrictions, in accordance with further implementations.

Figure 3A:
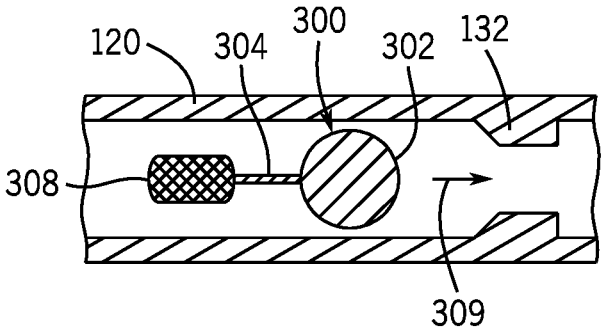
FIGS. 3A, 3B, 3C and 3D are schematic diagrams illustrating the use of untethered object assemblies to deliver agents downhole according to example implementations.

Regardless of the form of the restriction 130, in accordance with example implementations, an untethered object assembly may be pumped into the tubing string 120 for purposes of delivering an agent that is carried by the untethered object to a downhole region near or at the restriction 130. Referring to FIG. 3A, in accordance with example implementations, an untethered object assembly 300 includes a solid sphere, or ball 302, and a container 308, which is connected behind the ball 302 by a tethered connection 304. As depicted in FIG. 3A, the untethered object assembly 300 travels downhole in a direction 309 toward the seat 132 due to the pumping of fluid (for this example) into the string 120.

Figure 4A:
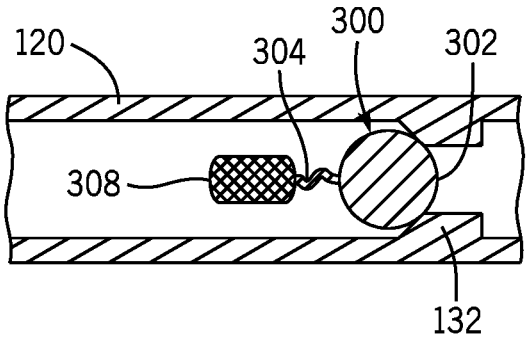
FIGS. 4A, 4B, 4C and 4D are schematic diagrams illustrating landing of untethered object assemblies on downhole restrictions according to example implementations.
Figure 5A:
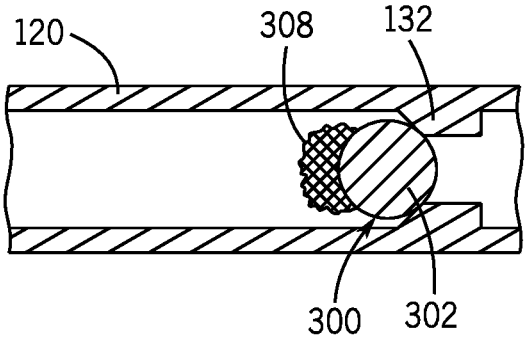
FIGS. 5A, 5B, 5C and 5D are schematic diagrams illustrating transformations of landed, untethered object assemblies to initiate release of agents carried by the assemblies according to example implementations.
Figure 6A:
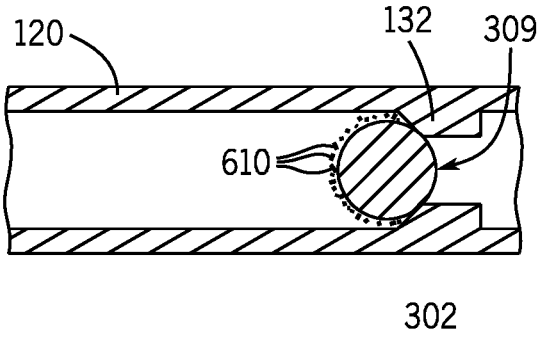
FIGS. 6A, 6B, 6C and 6D are schematic diagrams illustrating release of agents into the well according to example implementations.

Referring to FIG. 4A, the pumping of the untethered object assembly 300 causes the ball 302 to land in the restriction 132. Further pumping causes the collapse of the container 308, as illustrated in FIG. 5A. In this manner, pressure developed by the corresponding fluid obstruction, or barrier, formed by the ball 302 in the seat 132 causes the container 308 to be crushed, squeezed or deformed (depending on the particular implementation), which correspondingly causes the container 308 to open to release an agent that is contained therein. More specifically, referring to FIG. 6A, in accordance with example implementations, the opening of the container 308 causes the agent (depicted at reference numeral 610) to be released from the container 308.

As a more specific example, in accordance with some implementations, the agent 610 may be a sealing agent, such as coagulating particles (sand or proppant, as examples). As another example, the sealing agent may be an agent configured to plug relatively small interstices, such as a polymer powder or fiber or particles of a particular size.

The landing of the ball 302 in the seat 132 may, in accordance with example implementations, form an imperfect seal with the seat 132, even if the seat 132 is a continuous seat ring. Due to the imperfect seal, openings or interstices are created, which creates flow paths to occur between the ball 302 and the seat 132. These flow paths, in turn, deliver the agent 610 to the appropriate opening(s)to plug or seal the opening(s).

The agent may be an agent that is used for purposes other than sealing, in accordance with further example implementations. For example, in accordance with further example implementations, the agent may be used to accelerate, decelerate, initiate or inhibit the degradation rate of a particular downhole component, such as, for example, the seat 132. For example, the agent may be a chemical agent, such as a pH modifier or a temperature modifier (e.g., an agent that causes an exothermic reaction, for example). For implementations in which the agent is a relatively concentrated chemical, such as a concentrated acid, a degradation of not necessarily dissolvable alloys (such as alloys of a fracturing or bridge plug with aluminum and/or magnesium alloy) may occur due to the present of the agent.

As another example, the agent may be an agent that produces a protective coating or film on one or more downhole components. For example, the agent may deliver a wear or erosion protective film or coating on a solid part and/or the restriction 132. As examples, such agents include Xylan, Dykor, a solgel ceramic or a polytetrafluoroethylene (PTFE) material.

As another example, in accordance with further implementations, the agent may use to plug pores in the well. For example, the pores may be present around a predetermined location in the well. For example, the pores may be pores of a fracturing sleeve or any casing sleeve system. The pores may be pores of a formation, in accordance with further example implementations. In accordance with example implementations, the plugging may occur after a certain time, and as such, the untethered object assembly may be constructed to release the agent after a certain time delay, as described further herein.

Although flow paths are specifically mentioned above for purposes of delivering the agent from the untethered object to the region of interest, it is noted that other mechanisms, such as diffusion, may be used to deliver the agent, in accordance with further example implementations.

Figure 3B:
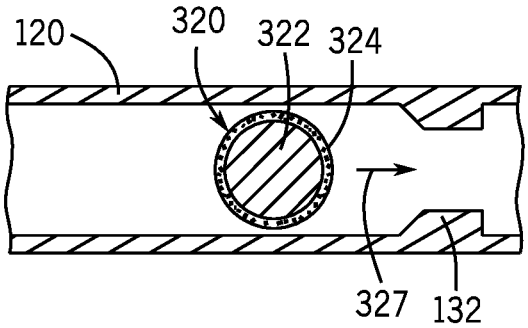

FIG. 3B depicts an untethered object assembly 320 in accordance with a further example implementation. Referring to FIG. 3B, the untethered object assembly 320 may be introduced into the tubing string 120 and pumped in a direction 327 toward the seat 132. The untethered object assembly 320 includes an inner solid sphere, or ball 322 (a metal or metal alloy ball, for example), and the agent is contained in an outer coating 324 that is affixed to the inner ball 322 while the assembly 320 is pumped downhole. In accordance with example implementations, the agent coating 324 is bonded or otherwise affixed to the exterior surface of the ball 322. As examples, the agent coating 324 may be formed on the outer surface of the ball 322 by overmolding, hot hydrostatic pressing (HIPing), dipping of the ball 322 into a bath, or spraying of the agent coating 324 onto the outer surface of the ball 322.

Figure 4B:
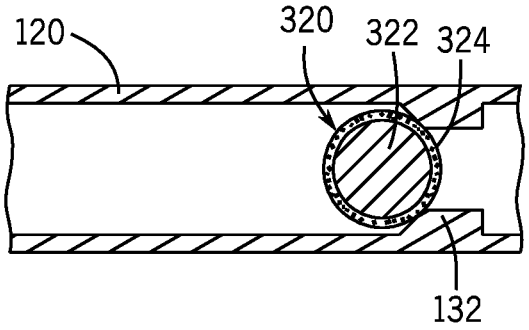
Figure 5B:
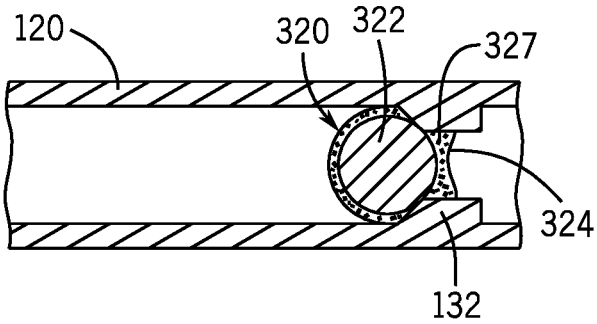
Figure 6B:
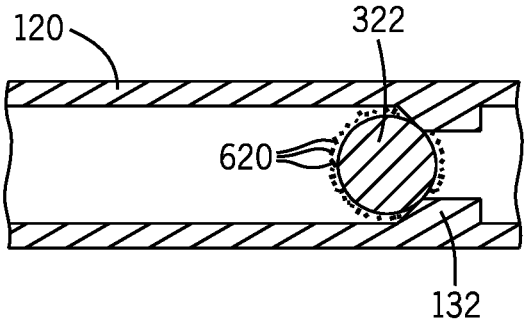

Referring to FIG. 4B, the untethered object assembly 320 is pumped until the assembly 320 lands in the seat 132, and as depicted in FIG. 5B, upon further pumping, the outer coating 324 deforms (as depicted by reference 32 in FIG. 5B) to eventually cause release of the agent, as depicted by reference numeral 620 in FIG. 6B.

Figure 3C:
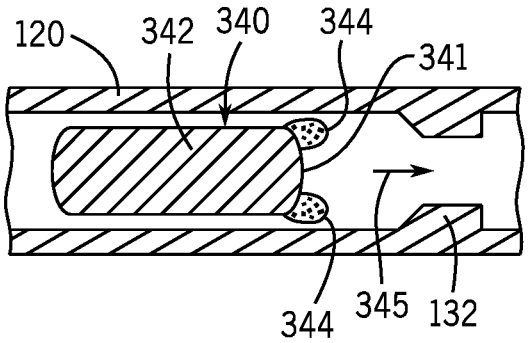
Figure 4C:
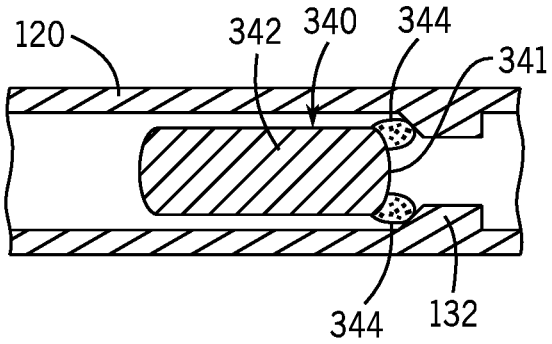
Figure 5C:
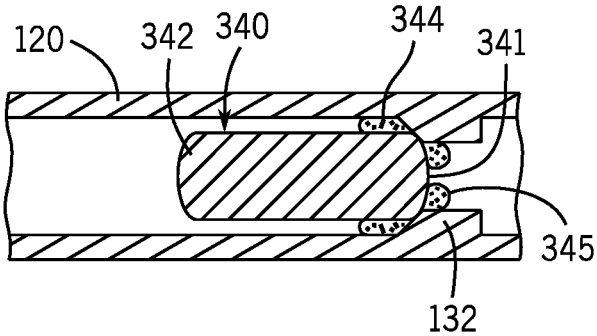
Figure 6C:
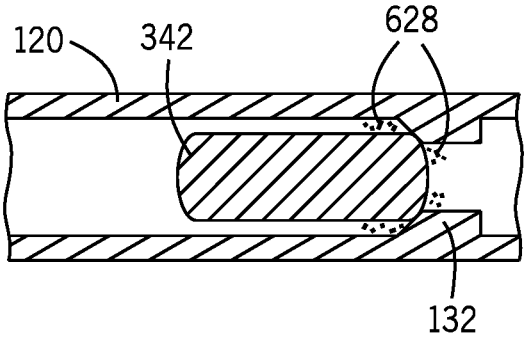

As another variation, FIG. 3C depicts an untethered object assembly 340 that has an oblong-shaped solid component 342 (a metal or metal alloy component, for example), and the agent is contained in a coating that is affixed to a downhole end of the oblong object 342, as depicted at reference numeral 344. The untethered object assembly 340 is pumped in a direction 345 toward the seat 132. Referring to FIG. 4C, a rounded surface 341 of the solid component 342 generally conforms to a profile of the seat 132, and upon landing of the untethered object assembly 340 in the seat 132, the coating 344 contacts the seat 132. As depicted in FIG. 5C, upon further pumping, the coating 344 deforms (as depicted by reference numeral 345) to release the agent, as depicted at reference 628 in FIG. 6C.

Figure 3D:
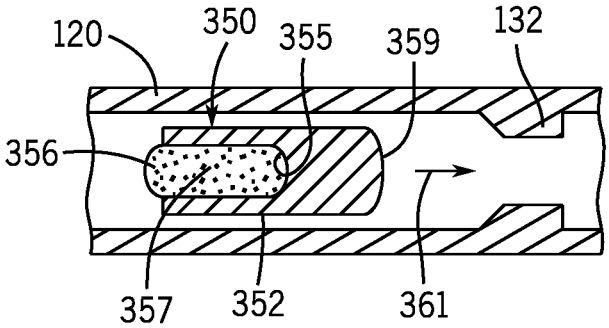
Figure 4D:
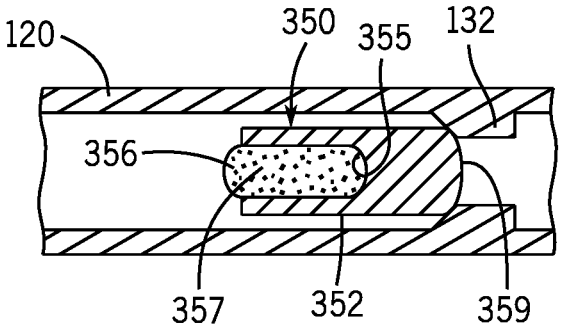
Figure 5D:
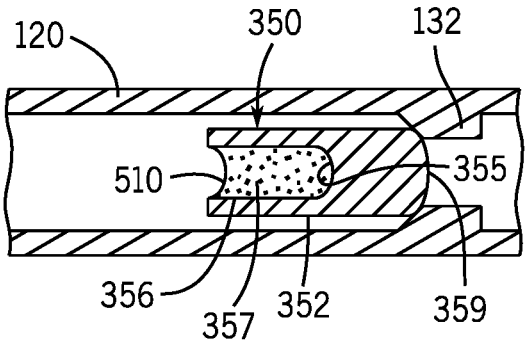
Figure 6D:
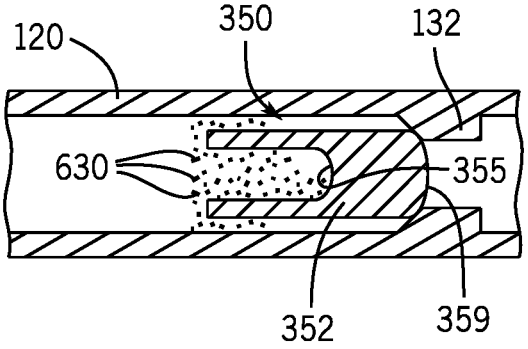

In accordance with a further example implementation, the agent may be contained inside an solid component of an untethered object assembly for purposes of delivering the agent downhole. In this manner, FIG. 3D depicts an untethered object assembly 350 that has an oblong-shaped generally solid component 352, which has an internal cavity 355 and generally has a surface 359 that conforms to a profile of the seat 132. The cavity 355 forms at least part of a container 356 to contain an agent 357. The untethered object assembly 350 is pumped in a direction 361 toward the seat 132. Upon pumping of the untethered object assembly 350 into the seat 132, a fluid barrier is produced, as depicted in FIG. 4D. The fluid barrier, in turn, is used to increase in a pressure uphole of the untethered object assembly 350, and this pressure opens the container 356. More specifically, FIG. 5D depicts a breach 510 of the container 356, which allows the agent to be released, as depicted by reference numeral 530 of FIG. 6D.

Figure 7:
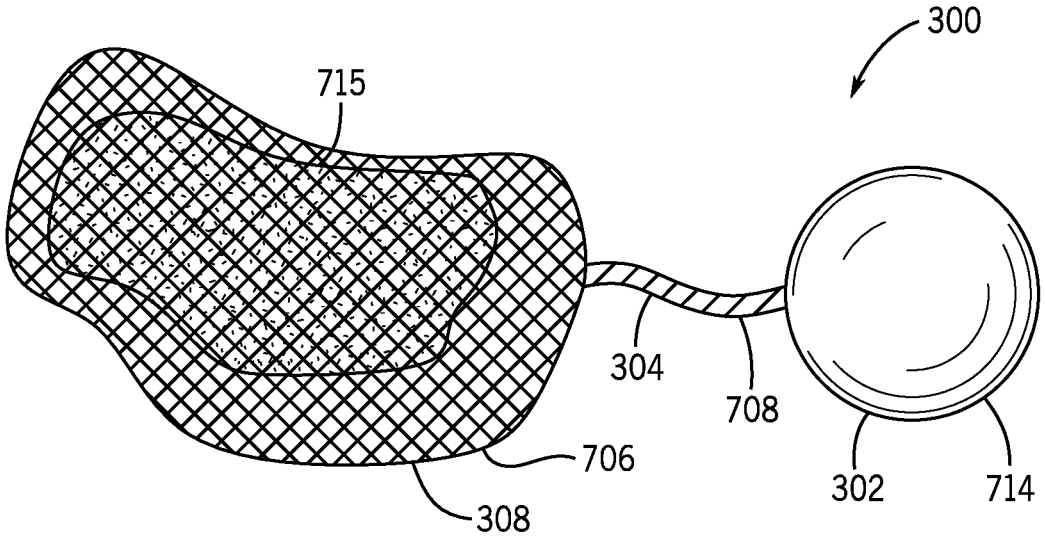
FIG. 7 is a perspective view of an untethered object assembly using a tethered container of the assembly to carry an agent into the well according to an example implementation.

Referring to FIG. 7, in accordance with example implementations, the untethered object assembly 320 includes a metal ball 714 and a mesh bag 706 that contains an agent 707. The bag 706 is tethered to the ball 714 via a cord 708. An agent 715 is contained in the bag 706 for purposes of delivering the agent 715 downhole.

Figure 8A:
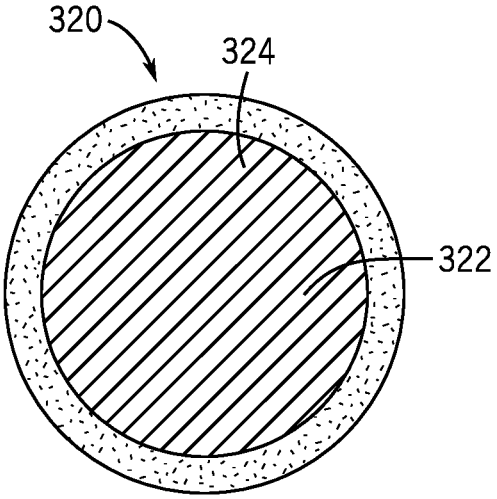
FIGS. 8A and 8B are cross-sectional views of sphere-shaped untethered object assemblies according to example implementations.
Figure 8B:
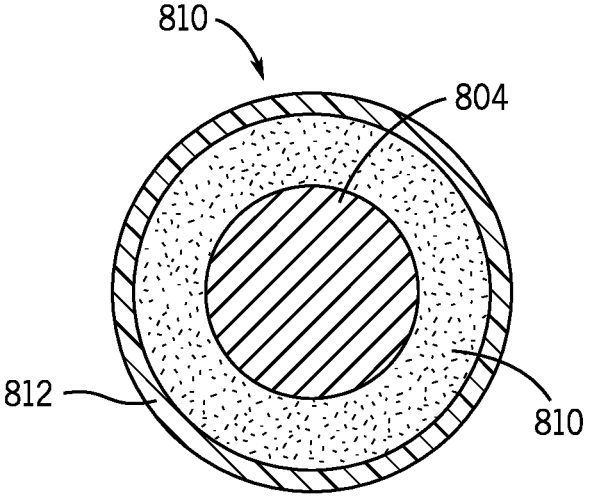

Referring to FIG. 8A, in accordance with example implementations, the untethered object assembly 320 has an inner metal or metal alloy ball 800 and an overmolded casing 810 that contains an agent. Referring to FIG. 8B, in accordance with further example implementations, an untethered object assembly 810 may, as depicted in FIG. 8B contain an inner metal or metal alloy ball 804, an agent layer 810 that surrounds and is affixed to the outer surface of the ball 804, and an outside protective layer, or shell 812. In this manner, according to example implementations, the agent layer 810 may be released due to the dissolving, cracking or crushing of the shell 812, depending on the particular implementation.

Figure 9A:
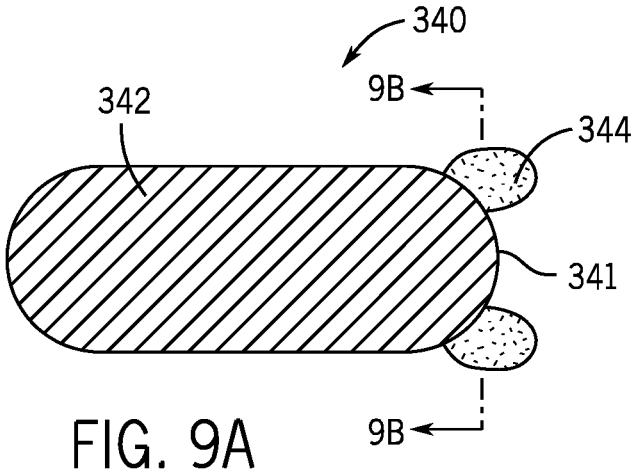
FIG. 9A is a lengthwise cross-sectional view of an untethered object assembly having an agent disposed on a front end of the object according to an example implementation.
Figure 9B:
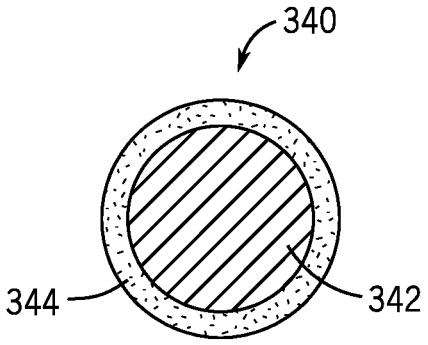
FIG. 9B is a traverse cross-sectional view of the untethered object assembly taken along line 9B-9B of FIG. 9A according to an example implementation.

Referring FIGS. 9A and 9B, in accordance with example implementations, the untethered object assembly 340 includes an oblong solid component 900 (a metal or metal alloy component, for example) and an agent ring 904 that is formed on a downhole end of the component 900. The ring 904 may be formed by overmolding onto the end of the solid component 900, in accordance with example implementations.

Figure 10A:
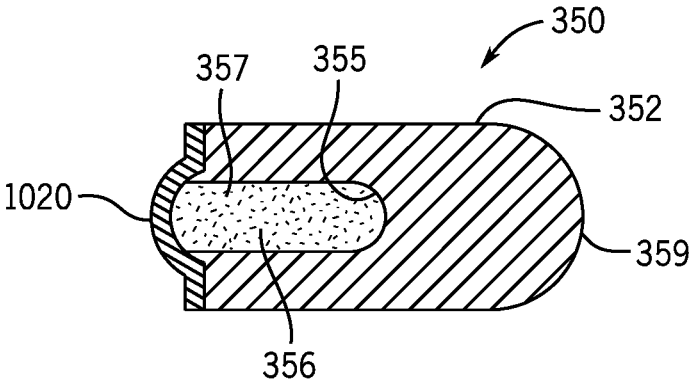
FIG. 10A is a lengthwise cross-sectional view of an untethered object assembly that carries an agent inside an internal cavity of the assembly according to an example implementation.

Referring to FIG. 10A, in accordance with example implementations, the untethered object assembly 350 may include a solid metal component 1010, which includes the inner cavity 355. For this example, the inner cavity 355 may be filled with a chemical agent 357 or may contain a bladder or other container that isolates the agent from the solid metal component 1010. At the uphole end of the component 1010, a rupture disk 1020 may be disposed to initially contain the agent 357 inside the internal cavity 355 to form the container 356. In this manner, the rupture disk 1020 is constructed to, in accordance with example implementations, rupture in response to a predetermined pressure, such as the pressure that occurs after the untethered object assembly 350 lands in the seat 132 to produce the pressure (due to the continued pumping) to breach the disk 1020 and release the agent 357.

Figure 10B:
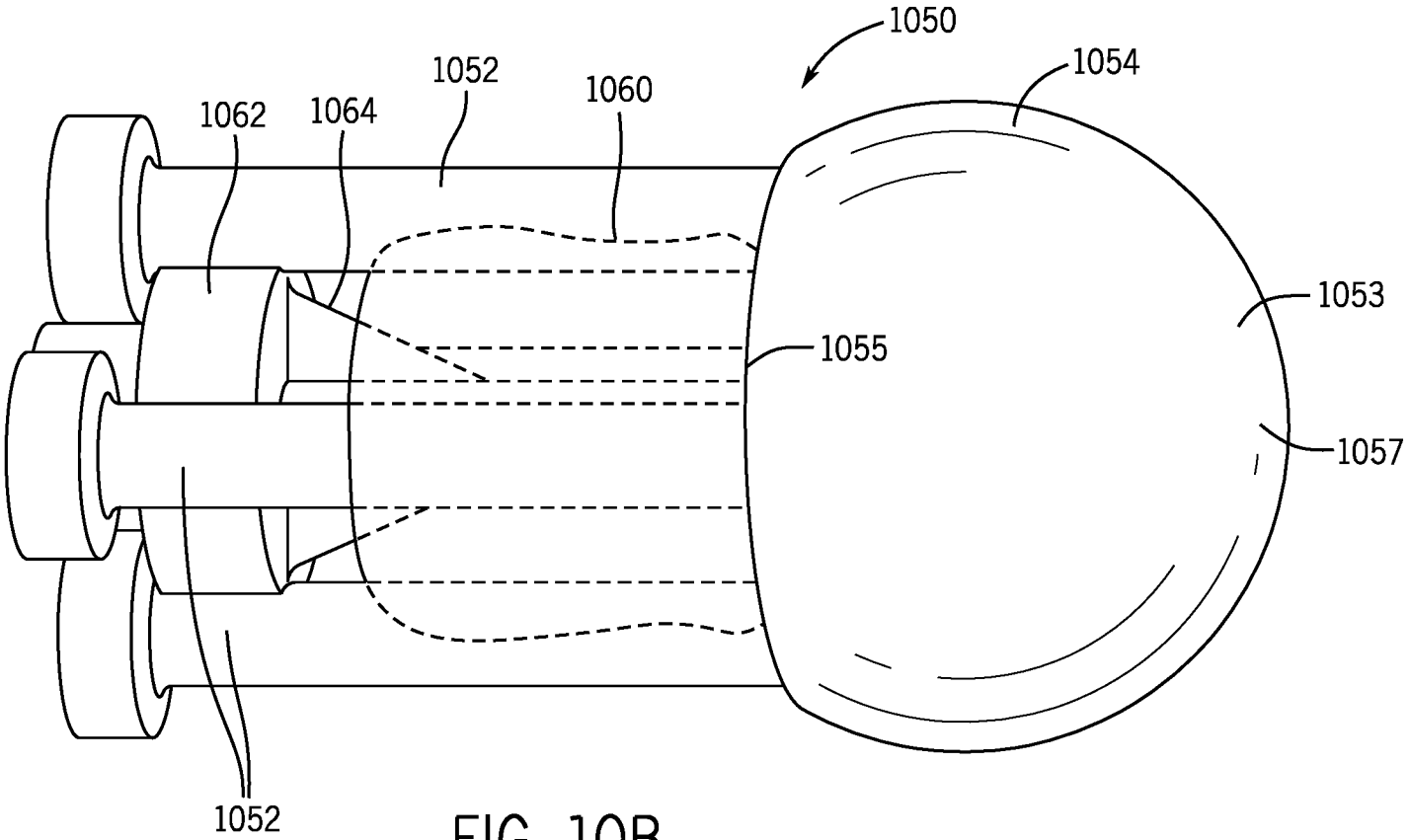
FIG. 10B is a perspective view of an untethered object assembly having a wedge to initiate release of an agent into the well according to an example implementation.

The untethered object/object assembly may have other forms, in accordance with further example implementations. As yet another example, FIG. 10B depicts an untethered object assembly 1050, which includes a solid body 1054 that has an inner space in which an agent-containing container 1060 and a wedge 1062 are disposed. The solid body 1054 includes a solid (metal or metal alloy, as examples) and rounded front end component 1053 and longitudinally extending guide members 1052 that extend from the component 1053. The front end component 1053 has a front seat forming surface 1057 (having a surface that conforms to the profile of the seat 132) and an anvil portion 1055. As shown in FIG. 10B, the container 1060 is disposed inside an annular space that is formed insides the guide members 1052. More specifically, the container 1060 is disposed between the wedge 1062 and the anvil portion 1055. The wedge 1062 is initially retained to the guide members 1052 via one or more shear pins (not shown) such that the container 1060 travels in the space between an impact point of the wedge 1062 and the anvil portion 1055 as the untethered object assembly 1050 travels downhole. In response to the surface 1053 landing in the seat 132, the momentum of the wedge 1062 produces a force to shear the shear pin(s), thereby releasing the wedge 1062 and allowing the wedge 1062 to travel toward the anvil position 1055 and breach the container 1060. The breaching of the container 1060, in turn, releases the agent contained therein.

Figure 11A:
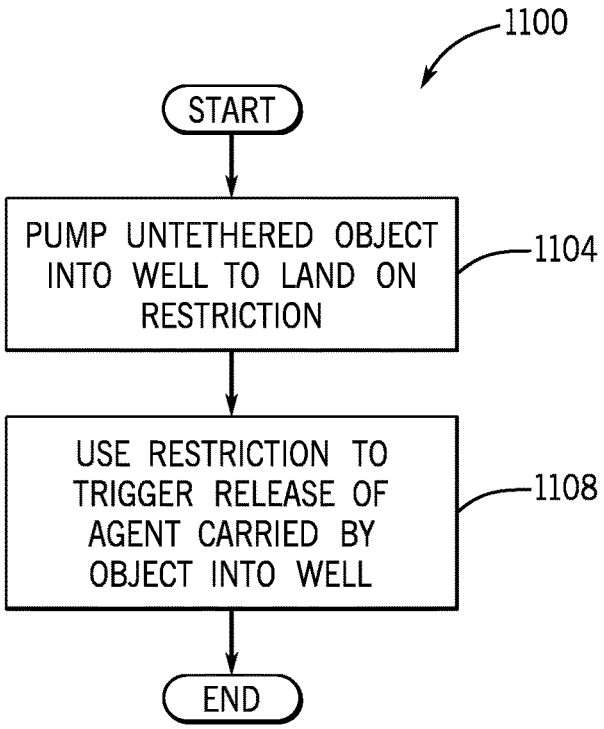
FIG. 11A is a flow diagram depicting a technique to deliver an agent downhole according to an example implementation.

Thus, in accordance with example implementations described herein, a technique 1100 that is depicted in FIG. 11A includes pumping (block 1104) an untethered object into a well to land on a restriction in the well and using (block 1108) the restriction to trigger the release of an agent that is carried by the object into the well.

Figure 11B:
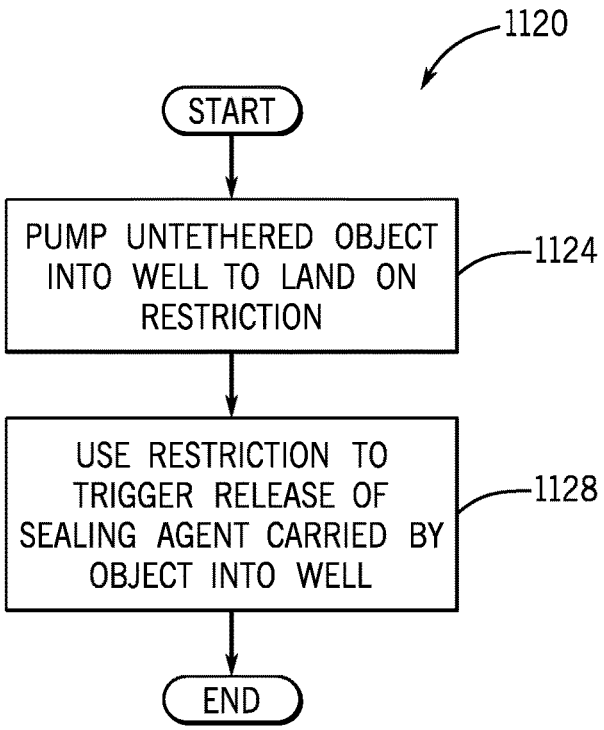
FIG. 11B is a flow diagram depicting a technique to use an untethered object to carry a sealing agent downhole according to an example implementation.

Referring to FIG. 11B, in accordance with example implementations, a technique 1120 includes pumping (block 1124) an untethered object into a well to land on a restriction in the well and using (block 1128) the restriction to trigger the release of a sealing agent carried by the object into the well.

Figure 11C:
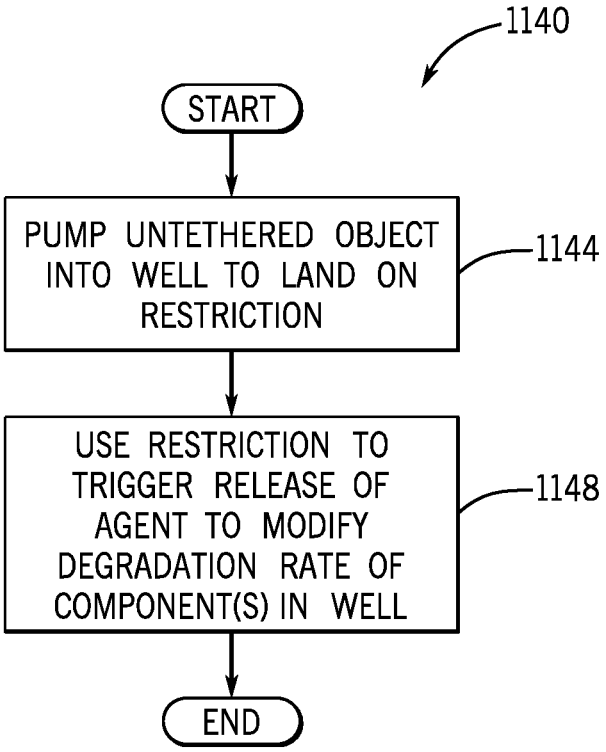
FIG. 11C is a flow diagram depicting a technique to use an untethered object to alter a component degradation rate downhole according to an example implementation.

In another application, a technique 1140 that is depicted in FIG. 11C includes pumping an untethered object into a well to land on a restriction of the well, pursuant to block 1144 and using (block 1148) the restriction to trigger release of an agent to modify a degradation rate of at least one component in the well.

Figure 11D:
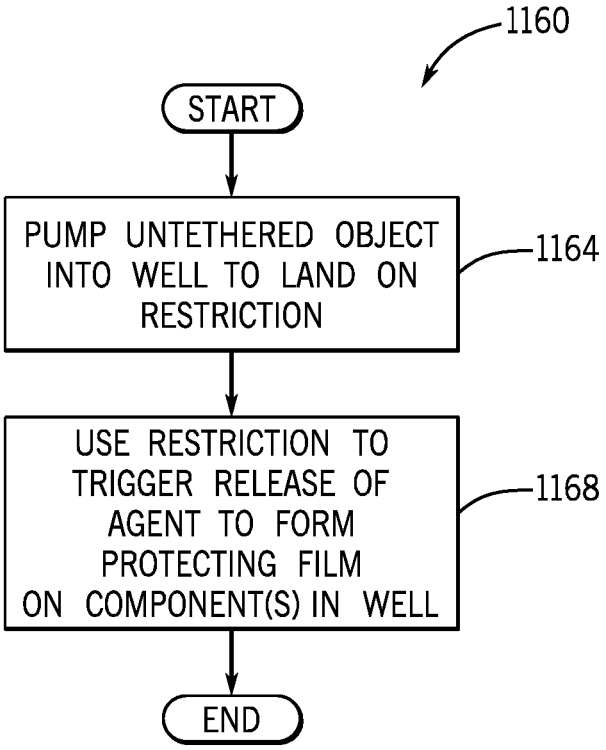
FIG. 11D is a flow diagram depicting a technique to use an untethered object to deliver a protective film agent downhole according to an example implementation.

In another application, a technique 1160 that is depicted in FIG. 11D includes pumping (block 1164) an untethered object into a well to land on a restriction in the well and using (block 1168) the restriction to trigger the release of an agent to form a protective film on at least one component in the well.

Figure 11E:
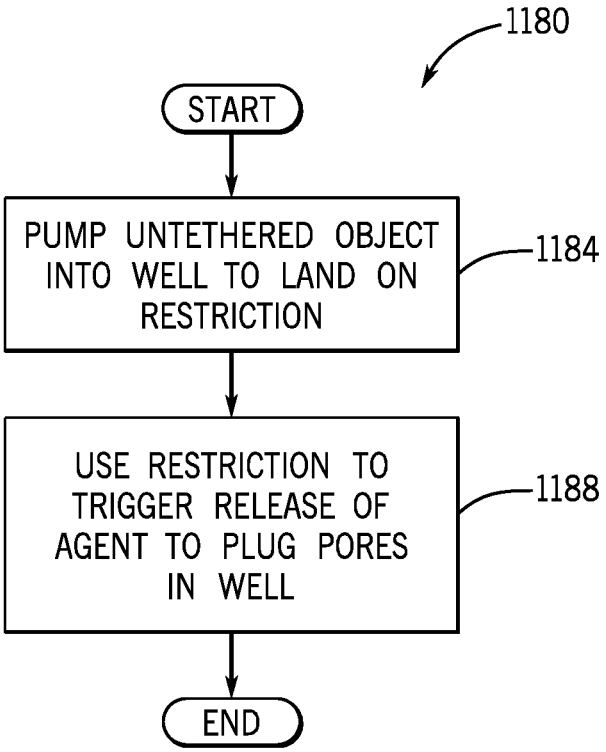
FIG. 11E is a flow diagram depicting a technique to use an untethered object to deliver an agent downhole to plug pores according to an example implementation.

In yet another application, a technique 1180 that is depicted in FIG. 11E includes pumping (block 1184) an untethered object into a well to land on a restriction in the well and using (block 1188) the restriction to trigger the release of an agent to plug pores in the well.

Other implementations are contemplated, which are within the scope of the appended claims. For example, in accordance with further example implementations, the chemical agent may be used to partially or fully dissolve the solid part of the untethered object assembly. In this regard, the dissolving of the solid part allows the untethered object assembly to pass through the restriction, thereby opening communication through the tubing string. As another variation, in accordance with example implementations, the agent that is released by the untethered object assembly may be used to dissolve part or all of the restriction for similar reasons. Moreover, in accordance with yet further example implementations, the solid part of the untethered object assembly and/or the restriction may be constructed from degradable materials, which dissolve or degrade with or without the aid of the agent contained in the untethered object. In this manner, Other implementations are contemplated, which are within the scope of the appended claims. For example, in accordance with further example implementations, the inner solid component of the untethered object may be constructed from a degradable/oxidizable material that degrades/oxidizes over time to remove the fluid barrier. In a similar manner, one or more components of the downhole restriction may be formed from such a degradable/oxidizable material.

As a more specific example, in accordance with example implementations, the degradable/oxidizable material may be constructed to retain its structural integrity for downhole operations that rely on the fluid barrier (fluid diversion operations, tool operations, and so forth) for a relatively short period of time (a time period for one or several days, for example). However, over a longer period of time (a week or a month, as examples), the degradable/oxidizable material(s) may sufficiently degrade in the presence of wellbore fluids (or other fluids that are introduced into the well) to cause a partial or total collapse of the material(s). In accordance with example implementations, dissolvable or degradable may be similar to one or more of the alloys that are disclosed in the following patents: U.S. Pat. No. 7,775,279, entitled, "Debris-Free Perforating Apparatus and Technique," which issued on Aug. 17, 2010; and U.S. Pat. No. 8,211,247, entitled, "Degradable Compositions, Apparatus Compositions Comprising Same, And Method of Use," which issued on Jul. 3, 2012.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method usable with a well, comprising:

pumping an untethered object into the well to land on a restriction downhole in the well; and using the restriction to trigger release of an agent carried by the object into the well, wherein using the restriction comprises:

using the restriction to trigger release of a sealing agent carried by the object into the well;

using the restriction to trigger release of an agent to form a protective film on at least one component of the well; or using the restriction to trigger release of an agent to plug pores in the well;

wherein the untethered object comprises a first component, a container containing the agent and a tethered coupling between the first component and the container, and using the restriction comprises:

landing the untethered object on the restriction; and using pressure developed from a fluid barrier produced from the landing to open the container to release the agent.

2. A method usable with a well, comprising:

pumping an untethered object into the well to land on a restriction downhole in the well; and using the restriction to trigger release of an agent carried by the object into the well, wherein using the restriction comprises:

using the restriction to trigger release of a sealing agent carried by the object into the well;

using the restriction to trigger release of an agent to form a protective film on at least one component of the well; or using the restriction to trigger release of an agent to plug pores in the well wherein the untethered object comprises a wedge and a container containing the agent, and using the restriction comprises:

landing the untethered object on the restriction; and using a momentum of the wedge to open the container in response to the landing.

3. An apparatus usable with a well, comprising:

a solid object adapted to be pumped into the well; and an agent adapted to be released from the solid object in response to the solid object landing on a restriction in the well, wherein the agent is selected from a set consisting essentially of a sealing agent, an agent to form a protective coating in the well, and an agent to plug pores in the well, wherein the solid object comprises a ball, and the agent comprises a layer formed on an exterior of the ball.

4. The apparatus of claim 3, wherein the agent is deposited on the exterior of the solid object near a downhole end of the object.

5. The apparatus of claim 3, wherein the solid object comprises an internal cavity, and the agent is disposed in the cavity.

6. A method usable with a well, comprising:

pumping an untethered object into the well to land on a restriction downhole in the well; and using the restriction to trigger release of an agent carried by the object into the well, wherein the untethered object comprises a solid object and the agent is disposed on an exterior of the solid object, and using the restriction comprises:

landing the untethered object on the restriction; and using a flow created due to the landing to remove the agent from the exterior of the solid object.

7. The method of claim 6, further comprising locating the agent toward a downhole end of the solid object.

* * * * *